US005526961A

United States Patent [19]

Burrows

[11] Patent Number: 5,526,961

[45] Date of Patent: Jun. 18, 1996

[54] SEALED ACTUATOR PROBE ASSEMBLY FOR A BOTTLED WATER STATION

[75] Inventor: Bruce D. Burrows, Valencia, Calif.

[73] Assignee: Ebtech, Inc., Columbus, Ohio

[21] Appl. No.: 539,969

[22] Filed: Oct. 6, 1995

Related U.S. Application Data

[63] Continuation of Ser. No. 202,727, Feb. 28, 1994, Pat. No. 5,464,127.

[51] Int. Cl.[6] ..... B67D 5/06

[52] U.S. Cl. ..... 222/185.1; 141/286; 141/351; 141/353; 141/364; 222/189.09; 222/69

[58] Field of Search ..... 222/146.1, 146.6, 222/189.09, 185.1, 69; 141/351, 353, 286, 364

[56] References Cited

U.S. PATENT DOCUMENTS

| | | | |
|---|---|---|---|
| 3,966,093 | 6/1976 | Frahm et al. | 222/185.1 |
| 3,974,863 | 8/1976 | Frahm et al. | 222/185.1 X |
| 4,874,023 | 10/1989 | Ulm | 141/364 X |
| 4,902,320 | 2/1990 | Schroer et al. | 222/185.1 X |
| 4,991,635 | 2/1991 | Ulm | 141/351 X |
| 5,031,676 | 7/1991 | Ulm | 141/364 X |
| 5,121,778 | 6/1992 | Baker et al. | 222/185.1 X |
| 5,222,531 | 6/1993 | Baker et al. | 222/185.1 X |
| 5,273,083 | 12/1993 | Burrows | 141/364 X |
| 5,289,854 | 3/1994 | Baker et al. | 141/351 X |
| 5,289,855 | 3/1994 | Baker et al. | 141/364 X |
| 5,295,519 | 3/1994 | Baker et al. | 141/364 X |
| 5,337,922 | 8/1994 | Salkeld et al. | 222/185.1 X |
| 5,413,152 | 5/1995 | Burrows | 141/353 X |
| 5,431,205 | 7/1995 | Gebhard | 141/353 X |
| 5,464,127 | 11/1995 | Burrows | 222/185.1 |

*Primary Examiner*—Kevin P. Shaver
*Attorney, Agent, or Firm*—Kelly Bauersfeld & Lowry

[57] ABSTRACT

An improved actuator probe assembly is provided for a bottled water station of the type having an actuator probe for engaging and opening a valved bottle cap on an inverted water bottle. The probe assembly comprises an inner support funnel and an outer adapter sleeve retained by a probe fitting in assembled relation with a cover plate adapted for mounting onto a station housing in a position over an upwardly open water reservoir. The support funnel extends downwardly through a central opening in the cover plate and defines a cup-shaped receiver structure for receiving and supporting an inverted water bottle, with the probe fitting positioned at a lower end of the support funnel and including the actuator probe. The adapter sleeve is carried about the support funnel and includes an outwardly radiating diaphragm member for closing the top of the reservoir when the cover plate is installed onto the station housing. A pair of annular seals located respectively on the support funnel and on the diaphragm member sealingly engage upper and lower surfaces of the cover plate. The seal on the diaphragm member additionally engages and seals with the reservoir. A vent path having a filter element therein extends from the reservoir through the diaphragm member and support funnel to the exterior of the bottled water station.

10 Claims, 3 Drawing Sheets

FIG. 1
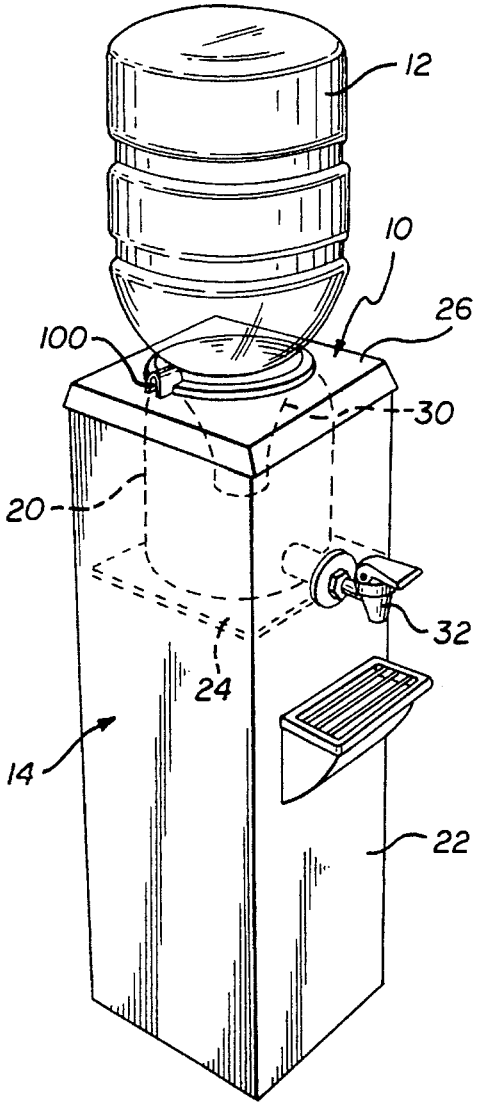
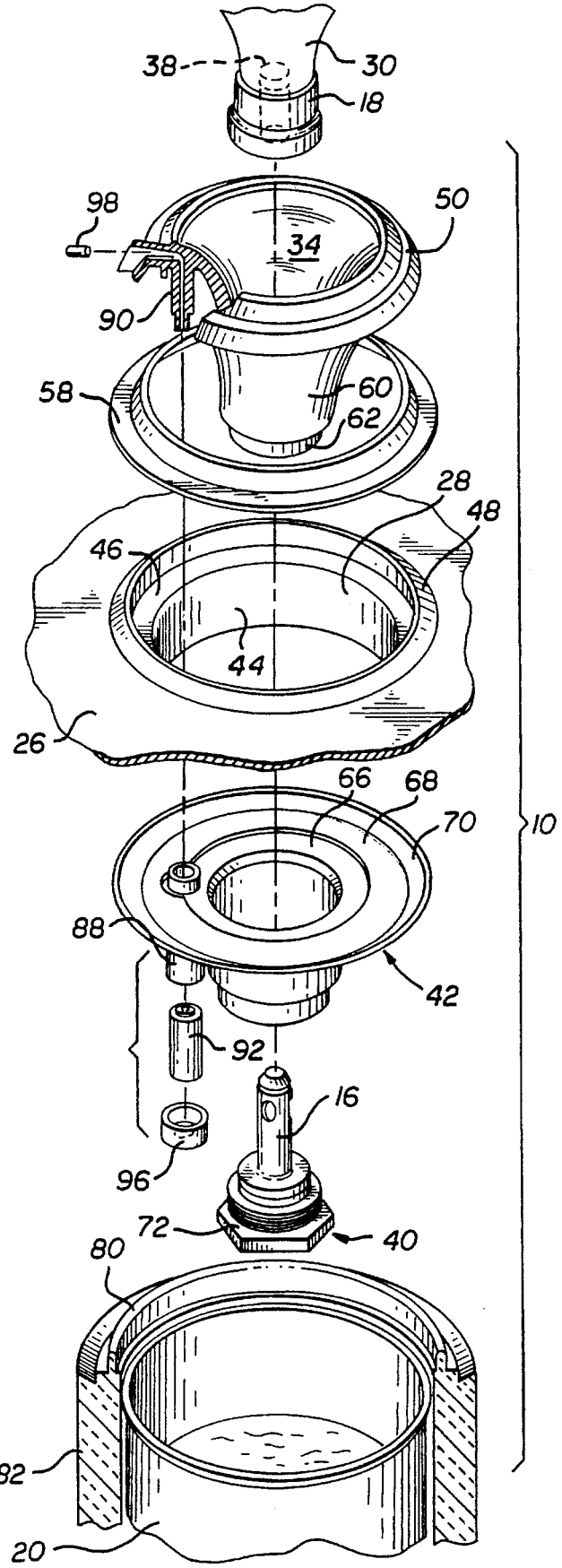
FIG. 2

SEALED ACTUATOR PROBE ASSEMBLY FOR A BOTTLED WATER STATION

This is a continuation of application Ser. No. 08/202,727, filed Feb. 28, 1994 now U.S. Pat. No. 5,464,127.

BACKGROUND OF THE INVENTION

This invention relates generally to bottled water stations of the type adapted to receive and support a water bottle in an inverted position, and to selectively dispense water therefrom. More particularly, this invention relates to improvements in bottled water stations designed for contamination-free delivery of water from an inverted water bottle to an underlying station reservoir.

Bottled water dispenser stations are well-known in the art for containing a supply of relatively purified water in a convenient manner and location ready for substantially immediate dispensing and use. Such bottled water stations commonly include an upwardly open water reservoir mounted within a station housing and adapted to receive and support an inverted water bottle of typically three to five gallon capacity. Water within the inverted bottle flows downwardly into the station reservoir for selective dispensing therefrom through a faucet valve on the front of the station housing. Such bottled water stations are widely used to provide a clean and safe source of water for drinking and cooking, especially in areas where the local water supply contains or is suspected to contain undesired levels of contaminants.

In bottled water stations of the above-described type, the water bottle is normally provided in a clean and preferably sterile condition with an appropriate sealing cap to prevent contamination of the water contained therein. When an inverted bottle on a station housing reaches an empty condition, the empty bottle can be lifted quickly and easily from the station housing and replaced by a filled bottle having the sealing cap removed therefrom. The empty bottle can then be returned to a bottled water vendor for cleaning and refilling.

While bottled water stations are widely used to provide a clean and safe supply of fresh water, undesired contamination of the bottled water can sometimes occur. For example, exterior surfaces of a bottle cap and the associated bottle neck can contact dirt and/or other contaminants in the course of bottle handling and storage prior to use. Removal of the bottle cap followed by installation of the bottle in an inverted position onto a station housing is frequently accompanied by a portion of the water contacting exterior surfaces of the bottle neck. Moreover, when the bottle is installed onto the station housing, at least a portion of the bottle neck is normally immersed within the water contained within the station reservoir. As a result, the potential exists for washing dirt and other contaminants from the exterior of the bottle neck into the station reservoir, thereby contaminating the bottled water supply.

In the past, a variety of valve arrangements have been proposed in an effort to prevent contamination in a bottled water station. Such valve arrangements have typically envisioned a bottle cap having a movable valve member, wherein the valve member is opened in the course of installing the water bottle onto the station housing. See, for example, U.S. Pat. Nos. 4,699,188; 4,874,023; 4,991,635; 5,121,778; and copending U.S. Ser. No. 773,024. In these prior devices, a tubular actuator probe is provided within a cylindrical support funnel or receiver mounted at the top of the station reservoir, wherein the tubular probe engages and opens the valve member on the bottle cap as an incident to bottle placement onto the station housing. The support funnel is normally associated with an annular seal which engages the reservoir, such that the probe and support funnel structure substantially close the otherwise upwardly open water reservoir to prevent and/or limit entry of dirt and other contaminants into the reservoir.

While bottled water stations of the above-described type having a valve actuator probe provide improved cleanliness within the water reservoir, portions of the support funnel and related probe structure at the top of the station reservoir are still susceptible to ingress of dirt and other contaminants, particularly such as ingress of small insects. More specifically, occasional problems have been encountered with respect to entry of ants and roaches and the like into the space between the bottle support funnel structure and the seal member engaging the top of the reservoir, resulting in accumulation of dirt and insect debris at this location. Efforts to clean this space typically and undesirably result in at least some of this insect-related debris falling into the underlying water reservoir, and thus contaminating the otherwise sanitary water contained therein.

There exists, therefore, a significant need for improvements in actuator probe and bottle support funnel structures for use in a bottled water station, wherein accumulation of dirt and other contaminants at the top of a station reservoir is substantially precluded. The present invention fulfills these needs and provides further related advantages.

SUMMARY OF THE INVENTION

In accordance with the invention, an improved actuator probe assembly is provided for use in a bottled water station. The actuator probe assembly includes a support funnel for receiving and supporting a water bottle in an inverted position, together with an actuator probe for engaging and opening a valved bottle cap on the water bottle. The support funnel and actuator probe are preassembled with a cover plate forming a portion of the bottled water station and adapted for mounting onto a station housing in a position over an upwardly open water reservoir. The actuator probe assembly includes seal means for sealingly engaging the water reservoir, and for sealingly contacting the cover plate at the upper and lower surfaces thereof, for purposes of maintaining the region of the bottled water station disposed above the reservoir in a clean and sanitary condition.

In the preferred form, the actuator probe assembly comprises the support funnel having a radially expanded upper rim which carries a first annular seal and has a size and shape to seat against and seal with an upper surface of the cover plate at location surrounding a central opening formed in the cover plate. The upper rim of the support funnel is joined to a cylindrical receiver which extends downwardly through the central opening in the cover plate. The cylindrical receiver extends through an outer adapter sleeve having an outwardly radiating diaphragm member with a second annular seal thereon in a position for seated and sealed engagement with a lower surface of the cover plate at a location surrounding the central opening. A probe fitting at a lower end of the funnel receiver retains the support funnel and adapter sleeve in assembled relation with the cover plate. The actuator probe is carried by the probe fitting in a position projecting upwardly within the support funnel.

The inner support funnel and outer adapter sleeve are thus preassembled with the cover plate of the bottled water station, with the first and second seals respectively engaging upper and lower surfaces of the cover plate. Subsequent mounting of the cover plate onto the station housing results in press-fit sealed engagement of the second seal member with the station reservoir. Entry of dirt and other contaminants into the space between the upper rim of the support funnel and the underlying reservoir is thus prevented.

A vent path is formed through the adapter sleeve and support funnel to extend from the water reservoir to the exterior of the bottled water station. This vent path is defined by interfitting tubular members formed on the diaphragm member of the adapter sleeve and on the support funnel, when those components are assembled with the cover plate. A filter element is installed along the vent path to prevent entry of dirt and other particulate into the station reservoir.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a front perspective view illustrating a bottled water station including the improved actuator probe assembly embodying the novel features of the invention;

FIG. 2 is an enlarged fragmented and exploded perspective view illustrating the improved actuator probe assembly of the present invention;

DETAILED DESCRIPTION OF THE PREFERRED EMBODIMENT

Figure 3:
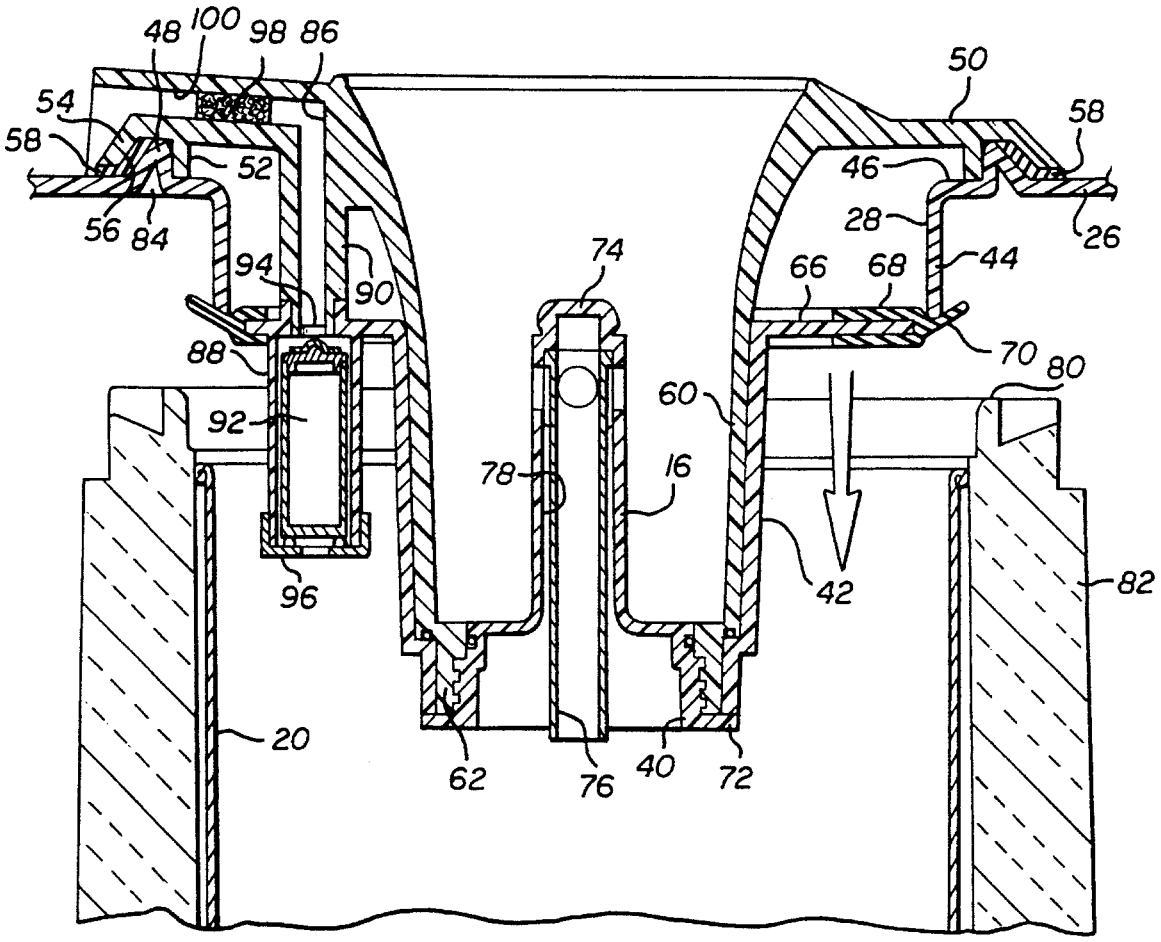
FIG. 3 is an enlarged fragmented vertical sectional view depicting the actuator probe assembly mounted onto a cover plate of the bottled water station, and further depicting installation of the cover plate onto an underlying station housing.

As shown in the exemplary drawings, an improved actuator probe assembly referred to generally in FIG. 1 by the reference numeral 10 is provided for receiving and supporting an inverted water bottle 12 on a bottled water station 14. The actuator probe assembly 10 includes an upstanding tubular probe 16 (FIG. 2) for engaging and opening a valved cap 18 on the water bottle 12. The probe assembly 10 includes improved seal structures for substantially preventing entry of dirt or other contaminants into the region of the bottled water station located above a water-containing reservoir 20.

The illustrative bottled water station 14 has a generally conventional overall size and shape to include an upstanding station housing 22 having an internal platform 24 which supports the reservoir 20. A cover plate 26 is installed onto the top of the housing 22 and has a central opening 28 formed therein. The water bottle 12 is installed onto the station housing in an inverted orientation, with a bottle neck 30 protruding downwardly through the central opening 28 in the cover plate 26. With this construction, as is known in the art, water contained within the bottle 12 will flow downwardly by gravity into the underlying station reservoir 20 until the reservoir reaches a substantially filled condition, at which time the water level within the reservoir 20 effectively shuts off further water downflow from the bottle. A spigot or faucet valve 32 is mounted in an accessible position on a front wall or panel of the station housing 22 and may be conveniently operated to dispense water from the reservoir. Such dispensing lowers the water level within the reservoir 20, resulting in a subsequent replenish downflow of water from the bottle 12.

Although the bottled water station 14 depicted in FIG. 1 includes a single faucet valve 32 for water dispensing purposes, it will be understood that the present invention may be applied to other types of bottled water stations having, for example, multiple faucet valves for dispensing water maintained at different temperatures within multiple station reservoirs, or within multiple zones of a single station reservoir. See, for example, U.S. Pat. No. 5,192,004 and copending U.S. Ser. No. 955,330, filed Oct. 1, 1992, which are incorporated by reference herein.

Figure 4:
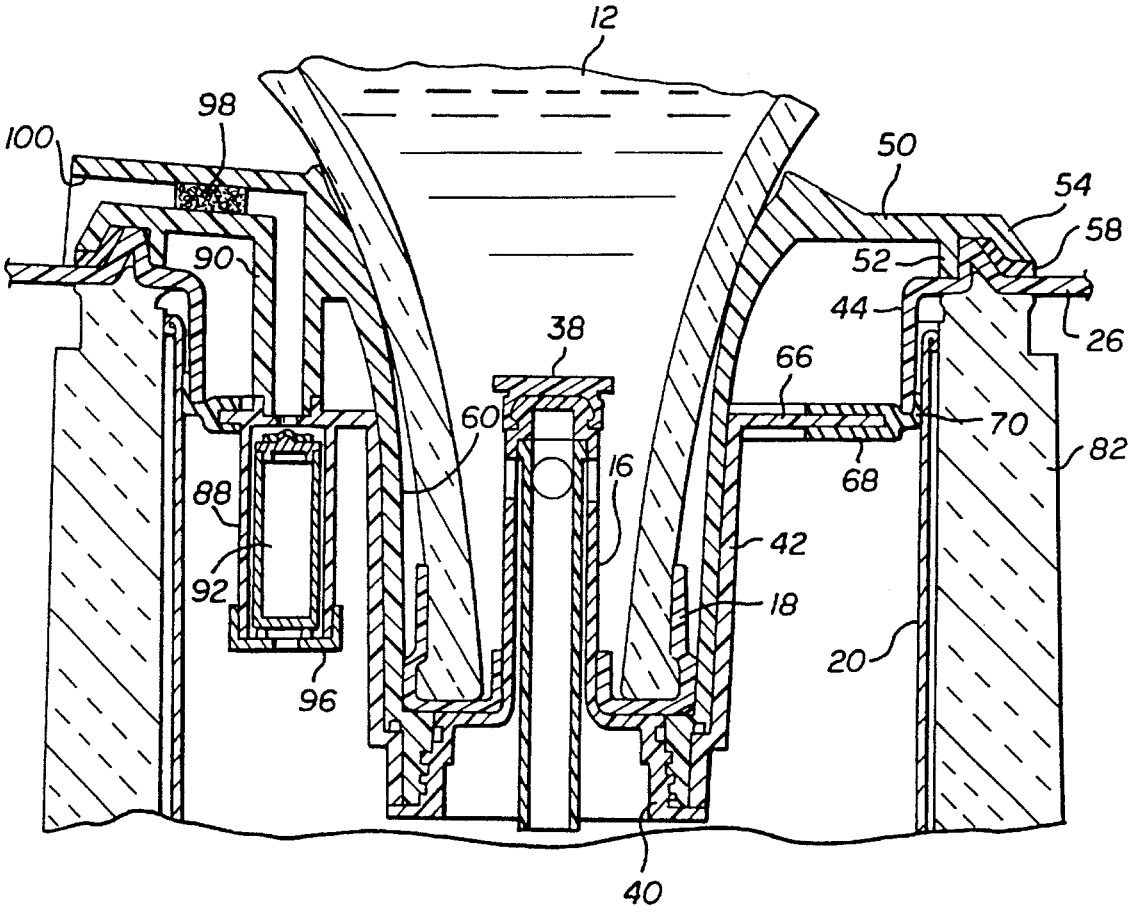
FIG. 4 is a fragmented vertical sectional view similar to FIG. 3, and showing the cover plate with actuator probe assembly installed onto the station housing.

As shown in FIGS. 2–4, the actuator probe assembly 10 generally comprises a support funnel 34 for receiving and supporting the neck 30 of the inverted water bottle 12, wherein the bottle neck 30 carries the bottle cap 18 of a type having a movable or separable valve member 38. A probe fitting 40 is mounted at a lower end of the support funnel 34 and includes the upstanding tubular probe 16 for engaging and opening the valve member 38 on the bottle cap 18, when the bottle 12 is installed onto the bottled water station. The support funnel 34 and probe fitting 40 are preassembled onto the cover plate 26, together with an adapter sleeve 42, in a manner which positively and substantially seals the reservoir 20 against undesired ingress of dirt and other contaminants.

The cover plate 26 has a conventional or typical construction to define the central opening 28 bounded by a relatively short, downwardly extending cylindrical wall 44. This cylindrical wall 44 defines an inner margin of a shallow recess 46 formed about the central opening 28, wherein an outer margin of the recess 46 is defined by a short upstanding shoulder 48.

The support funnel 34, constructed in a preferred form from lightweight molded plastic, includes a radially expanded or enlarged upper rim 50 having a size and shape to overlie the recess 46 and shoulder 48 on the cover plate 26. In this regard, as shown in FIGS. 2–4, the upper rim 50 includes a pair of concentric and downwardly extending support legs 52 and 54 near the outer periphery thereof to cooperatively define a downwardly presented channel 56 for seated reception of the raised shoulder 48 on the cover plate. A first annular seal ring 58 is seated between the funnel rim 50 and an upper surface of the cover plate 26, preferably by compressive engagement between the outer support leg 54 and an upper surface of the cover plate disposed on an annulus surrounding or circumscribing the raised shoulder 48.

The expanded upper rim 50 of the support funnel 34 blends smoothly and curvedly with a downwardly extending and generally cylindrical receiver 60 having a size and shape to fit with clearance through the central opening 28 in the cover plate 26. A lower end of the receiver 60 defines an internally threaded fitting 62 adapted for thread-in mounting of the probe fitting 40, as will be described. Importantly, the contoured shape of the support funnel 34 including the expanded outer rim 50 and the cylindrical receiver 60 forms an upwardly open and generally cup-shaped support structure for receiving and supporting the water bottle 12 in an inverted orientation on top of the bottled water station 14.

The adapter sleeve 42 is retained concentrically about the receiver 60 of the support funnel 34 in press-fit sealed engagement with an underside or lower surface of the cover plate 26. More specifically, the adapter sleeve 42 comprises a generally cylindrical sleeve body having a size and shape for sliding, relatively close-fit mounting about the receiver 60 of the support funnel 34, at a location beneath the cover plate. This adapter sleeve body is joined at an upper end thereof to a radially enlarged diaphragm member 66 having a diametric size close to but slightly less than the size of the central opening 28. A second annular seal ring 68 is mounted at the periphery of the diaphragm member 66 and includes a resilient seal flap 70 protruding radially outwardly therefrom. The diametric size of the seal flap 70 is greater than the size of the central opening 28 in the cover plate 26, and also greater than the diametric size of the reservoir 20.

The probe fitting 40 positions and retains the support funnel 24 and the adapter sleeve 42 in assembled relation with the cover plate 26, with the seal flap 70 seated against the lower marginal edge of the cylindrical wall 44 lining or circumscribing the opening 28 in the cover plate 26. More specifically, a radially outwardly projecting flange 72 on the probe fitting 40 engages a lower end of the adapter sleeve 42, upon threaded reception of the probe fitting 40 into the threaded fitting 62 of the support funnel 34. This flange 72 thus positions and retains the adapter sleeve 42 about the support funnel 34, with the seal flap 70 engaging the cylindrical wall 44. In this position, as shown in FIGS. 3 and 4, the probe fitting 40 closes the lower end of the support funnel 34, and orients the probe 16 in a position upstanding within the receiver 60.

The probe 16 defines a probe head 74 for engaging and opening the valve member 38 on the bottle cap 18. Parallel flow paths 76 and 78 are formed in the probe 16 for smooth water downflow from the bottle 12 to the reservoir 20, and smooth air exchange upwardly from the reservoir to the interior of the bottle. Further details regarding the construction and operation of the dual-path the probe 16 and related valved bottle cap may be found by reference to copending U.S. Ser. No. 773,024, filed Oct. 7, 1991, which is incorporated by reference herein.

The actuator probe assembly 10 is thus preassembled quickly and easily with the cover plate 26, with the seal rings 58 and 68 respectively and sealingly engaging upper and lower surfaces of the cover plate. This cover plate subassembly, including the probe assembly 10, is then installed quickly and easily onto the station housing 22, as shown in FIGS. 3 and 4. When installed, the seal flap 70 of the second or lower seal ring 68 is press-fitted into the upper end of the reservoir 20 in sealed relation therewith. Thus, the seal flap 70 provides a dual seal function wherein the diaphragm member 66 of the adapter sleeve 42 closes the upper end of the reservoir 20, and further wherein the adapter sleeve 42 and reservoir 20 are sealingly engaged with the housing cover plate 26.

In addition, when the cover plate 26 is installed onto the station housing, an upper marginal edge 80 of an insulation jacket 82 carried about the reservoir 20 may conveniently engage the underside of the cover plate 26, such as by press-fit reception into an annular channel 84 defined at the underside of the cover plate structure forming the raised shoulder 48. These various seal structures thus positively prevent entry of dirt, debris, insects, or other undesired matter into the space disposed above the diaphragm member 66 at the top of the reservoir 20.

A vent path 86 is provided through the actuator probe assembly 10, for purposes of venting the reservoir 20 and thereby assuring proper water downflow from the bottle 12 to the station reservoir 20. As shown, the vent path 86 is defined by interfitting tubular segments 88 and 90 formed integrally with the diaphragm member 66 and the funnel rim 50. In the preferred form, the tubular segment 88 on the adapter sleeve has a float valve 92 slidably carried therein for movement between a control port 94 and a ported retainer cap 96. The float valve 92 will move upwardly to engage and close the control port 94, in the event that undesired bottle leakage results in excessive filling of the station reservoir 20. By closing the control port 94, the vent path 86 will be closed, and further water downflow will be prevented.

An air filter 98 is seated within the vent path 86, preferably by press-fit installation into a laterally open segment 100 in flow communication with the tubular segment 90 in the support funnel. The air filter 98 and vent path 80 thus provide appropriate venting of the reservoir interior, while precluding ingress of undesired dirt and other contaminants.

A variety of modifications and improvements to the actuator probe assembly of the present invention will be apparent to those skilled in the art. Accordingly, no limitation on the invention is intended by way of the foregoing description and accompanying drawings, except as set forth in the appended claims.

What is claimed is:

1. A bottled water station for receiving and supporting a water bottle having a valved cap, said bottled water station comprising:

an upwardly open water reservoir for receiving and storing a supply of water;

an actuator probe assembly for mounting onto said reservoir and including a support funnel having a radially enlarged upper rim and joined to a generally cylindrical receiver extending from said upper rim in a downward direction into said reservoir, a first seal disposed generally on said upper rim, a diaphragm member extending radially outwardly from said support funnel at a position within said reservoir, a second seal carried by said diaphragm member for engaging said reservoir, and an actuator probe mounted generally at a lower end of said receiver and upstanding therein; and a generally cylindrical wall element interposed between and engaging said first and second seals.

2. The bottled water station of claim 1 wherein said actuator probe assembly further defines a vent path extending from said reservoir to the exterior of said reservoir when said probe assembly is mounted onto said reservoir, and further including a filter element mounted along said vent path.

3. The bottled water station of claim 2 further including a safety float valve mounted along said vent path.

4. The bottled water station of claim 1 further including an adapter sleeve carried about said receiver, said diaphragm member extending radially outwardly from said adapter sleeve, and a probe fitting having said actuator probe thereon and including means for retaining said support funnel and said upper sleeve in assembled relation.

5. In a bottled water station for receiving and supporting a water bottle having a valved cap, said bottled water station including an upwardly open water reservoir, an actuator probe assembly comprising:

a support funnel having a radially enlarged upper rim and joined to a generally cylindrical receiver extending from said upper rim in a downward direction;

a first seal carried by said upper rim;

a diaphragm member extending radially outwardly from said support funnel at a position below said upper rim;

a second seal carried by said diaphragm member;

an actuator probe mounted generally at a lower end of said receiver and upstanding therein;

said second seal on said diaphragm member sealingly engaging said reservoir when said actuator probe assembly is mounted onto said reservoir; and a generally cylindrical wall element interposed between and engaging said first and second seals.

6. The actuator probe assembly of claim 5 wherein said actuator probe assembly further defines a vent path extending from said reservoir to the exterior of said reservoir when said probe assembly is mounted onto said reservoir, and further including a filter element mounted along said vent path.

7. The actuator probe assembly of claim 6 further including an safety float valve mounted along said vent path.

8. The actuator probe assembly of claim 5 further including an adapter sleeve carried about said receiver, said diaphragm member extending radially outwardly from said adapter sleeve, and a probe fitting having said actuator probe thereon and including means for retaining said support funnel and said adapter sleeve in assembled relation.

9. In a bottled water station for receiving and supporting a water bottle having a valved cap, said bottled water station including an upwardly open water reservoir structure, an actuator probe assembly comprising:

a support funnel having a radially enlarged upper rim and joined to a generally cylindrical receiver extending from said upper rim in a downward direction;

a first seal carried by said upper rim;

a diaphragm member extending radially outwardly from said support funnel at a position below said upper rim;

a second seal carried by said diaphragm member; and an actuator probe mounted generally at a lower end of said receiver and upstanding therein;

said actuator probe assembly having a size and shape for mounting onto said reservoir structure with said first seal in sealing engagement with an upper end of said reservoir structure and with said second seal positioned within said reservoir structure in sealing engagement therewith.

10. The actuator probe assembly of claim 9 further including a generally cylindrical wall segment interposed between said first and second seals.

* * * * *